United States Patent [19]

Katona

[11] 4,384,567

[45] May 24, 1983

[54] SELF-CONTAINED WINDOW UNIT FOR SOLID FUEL BURNER

[75] Inventor: Joseph W. Katona, Walled Lake, Mich.

[73] Assignee: Mills Products, Inc., Farmington, Mich.

[21] Appl. No.: 302,048

[22] Filed: Sep. 14, 1981

[51] Int. Cl.[3] ..... F23M 7/00; E04C 2/38

[52] U.S. Cl. ..... 126/200; 52/656

[58] Field of Search ..... 40/155, 152; 126/200; 52/475, 656, 509, 511

[56] References Cited

U.S. PATENT DOCUMENTS

| | | | |
|---|---|---|---|
| 381,101 | 4/1888 | Beecher | 126/200 |
| 2,969,787 | 1/1961 | Dupler | 126/200 |
| 3,358,674 | 12/1967 | Chrisholm | 126/193 |
| 3,867,048 | 2/1975 | Endzweig | 52/656 |
| 4,193,238 | 3/1980 | Chalmers | 52/656 |
| 4,205,470 | 6/1980 | Kapnek | 52/656 |
| 4,292,488 | 9/1981 | Birk | 126/200 |

*Primary Examiner*—Samuel Scott
*Assistant Examiner*—G. Anderson
*Attorney, Agent or Firm*—Barnes, Kisselle, Raisch, Choate, Whittemore & Hulbert

[57] ABSTRACT

A self-contained window unit that may be installed in a solid fuel burner or like device. The window unit comprises a safety shield which may consist of a glass pane and/or a safety screen, and a frame surrounding the safety shield. The frame is composed of frame elements fabricated in separate lengths with brackets at the corners of the frame to secure the frame elements together. Preferably there is a cushion element between the safety shield and the frame to minimize the risk of breakage. The unit may be mounted on the fuel burner by hanger brackets on the frame or by threaded studs carried by the brackets.

9 Claims, 9 Drawing Figures

SELF-CONTAINED WINDOW UNIT FOR SOLID FUEL BURNER

This invention relates generally to window units and refers more particularly to a self-contained window unit for solid fuel burners and the like.

SUMMARY OF THE INVENTION

The self-contained window unit of this invention may be installed in a solid fuel burner or the like, such as a wood-burning stove, to permit viewing the fire while reducing the hazard of fire. In accordance with a specific embodiment about to be described, the window unit includes a safety shield surrounded by a border frame. Preferably, the safety shield is rectangular and the frame is fabricated in four separate frame elements held together by brackets or clamps at the corners of the frame. The corner brackets or clamps may be provided with threaded studs for the purpose of mounting the window unit on a solid fuel burner. A means of staking is provided to secure the brackets in the corners of the frame to hold all components of the window unit in proper relationship prior to installation in the intended opening.

If necessary or desired, additional mounting brackets or clamps may be installed between the corners, which may be free to slide within the frame or staked in place.

A cushion and seal member may be inserted between the frame and the periphery of the safety shield. The safety shield may be a pane of appropriate heat-resistant glass with or without an overlying safety screen, or the screen may be used alone. The glass minimizes loss of room air.

The window unit provides a simple, economic and suitable means of mounting and supporting the safety shield. Adequate space for glass expansion is provided to minimize breakage. The mounting studs are hidden to provide a smooth pleasing appearance. The safety screen when used will reduce the hazard of fire.

In alternative constructions, the frame may be provided with hanger brackets for mounting the unit on a solid fuel burner. Also, the cushion and seal for the safety shield may be provided with openings to allow a controlled amount of air to pass around the periphery of the shield.

Other objects and features of the invention will become more apparent as the following description proceeds, especially when considered with the accompanying drawings.

DETAILED DESCRIPTION

Figure 1:
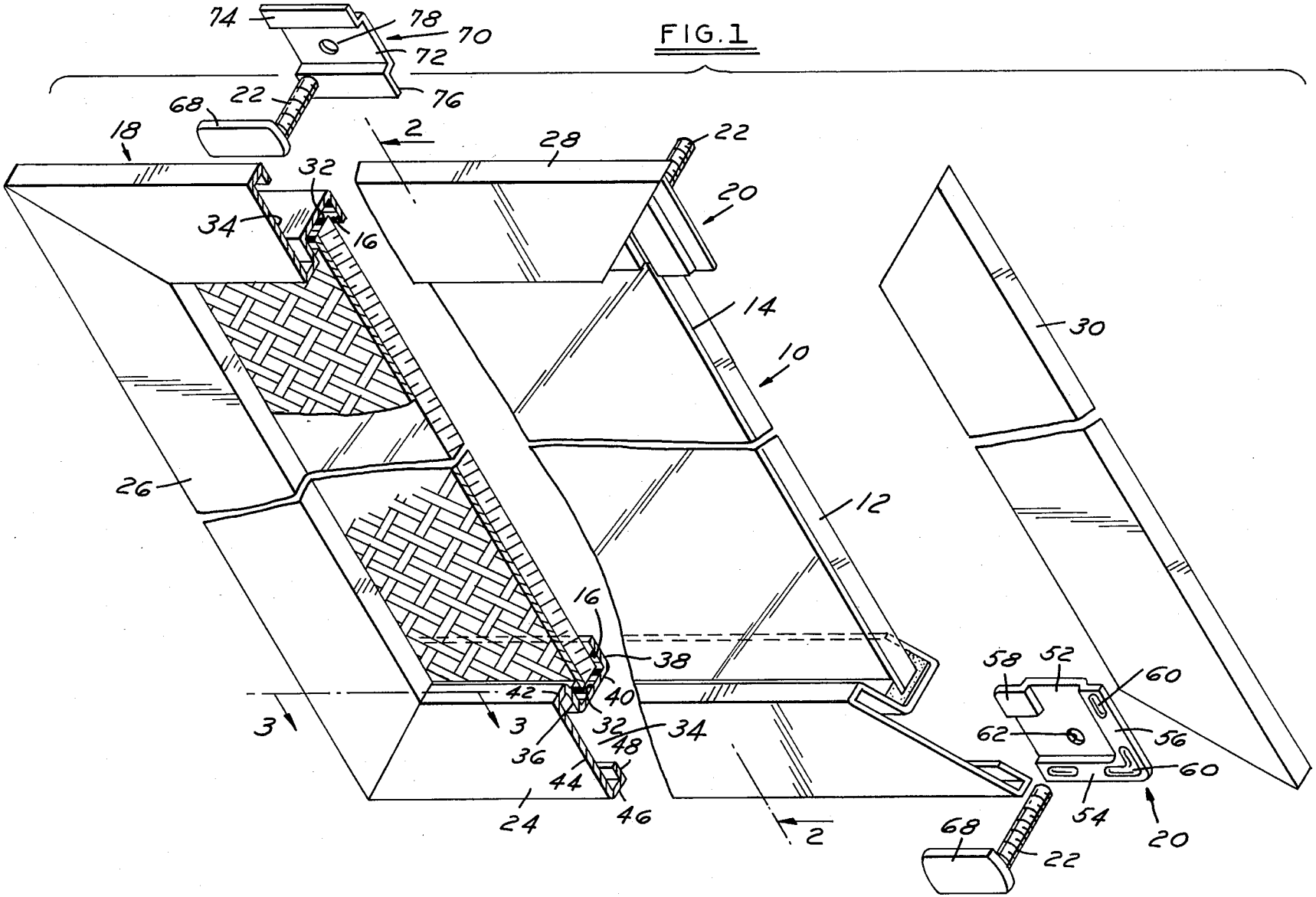
FIG. 1 is an exploded perspective view, with parts broken away in section, of a self-contained window unit constructed in accordance with the invention.

Referring now more particularly to the drawings and especially to FIGS. 1 to 4, the self-contained window unit there shown in composed of a safety shield 10 having a glass pane 12 and screen 14, a cushion and seal element 16 around the periphery of the safety shield, a border frame 18, and brackets or clamps 20 at the four corners of the frame provided with threaded studs 22.

The pane 12 is preferably a flat rectangular member of an appropriate heat resistant glass. The safety screen 14 is of the same rectangular dimension as the glass pane and serves to minimize the hazard of fire. The screen 14 is perforated and overlies the glass pane in surface-to-surface relation.

The frame 18 is preferably fabricated in four separate lengths or elements 24, 26, 28 and 30. The frame elements may be roll formed to the configuration shown from an elongated piece of flat stock, preferably metal. The configuration of all of the frame elements 24–30 is the same, having an inwardly opening channel 32 and a rearwardly opening slot 34. The channel 32 is formed of the spaced parallel side walls 36 and 38 which extend parallel to the glass pane 12 and screen 14, and the web or base 40 which extends at right angles between the side walls 36 and 38. The side wall 36 at its inner extremity is bent forwardly parallel to base 40 to provide wall 42, then is bent outwardly parallel to side wall 36 to provide the front wall 44 which at its outer extremity is bent rearwardly parallel to wall 42 to provide the wall 46 which terminates in an inturned wall or flange 48 parallel to and coplanar with wall 36. The walls 36, 38 and 40 define the inwardly opening channel 32 and the walls 36, 42, 44, 46 and 48 define the slot 34. The channel 32 and slot 34 are open at both ends of each frame element.

The slot 34 is open along the full length of each frame element, the opening being defined between the adjacent edges of walls 36 and 48.

The frame elements 24–30 are arranged end-to-end along the four sides of the safety shield with the ends of the frame elements mitered where they abut at the four corners of the frame so that the channels 32 of the frame elements connect with one another at the corners as do the slots 34. The peripheral portions of the safety shield are received in the channels of the four frame elements, but are separated from contact with the channels by an elongated substantially continuous peripheral cushion and seal element 16 of fiber glass or the like. This cushion and seal element 16 allows for expansion of the glass in order to minimize the risk of breaking.

The frame elements are held together and in proper alignment at the mitered corners by means of the brackets or clamps 20. Each bracket 20 is a rectangular plate-like member, the central portion 52 of which is depressed rearwardly from the plane of the plate to provide the raised edge portions 54 and 56 along the two adjacent outer edges of the bracket and the raised inner corner portion 58. Each bracket 50 is located in one of the four corners of the frame, being disposed partially within the slots of each of the two frame elements abutting at the corner where that particular bracket is located and with the central depressed portion 52 of the bracket projecting into the opening of the slot defined between the adjacent edges of the walls 36 and 48. The raised edge portions 54 and 56 have depressions 60 into which the material of the flange or wall 48 of the frame elements may be deformed to stake the brackets to the frame elements and retain them in assembled relation around the periphery of the safety shield.

Figure 2:
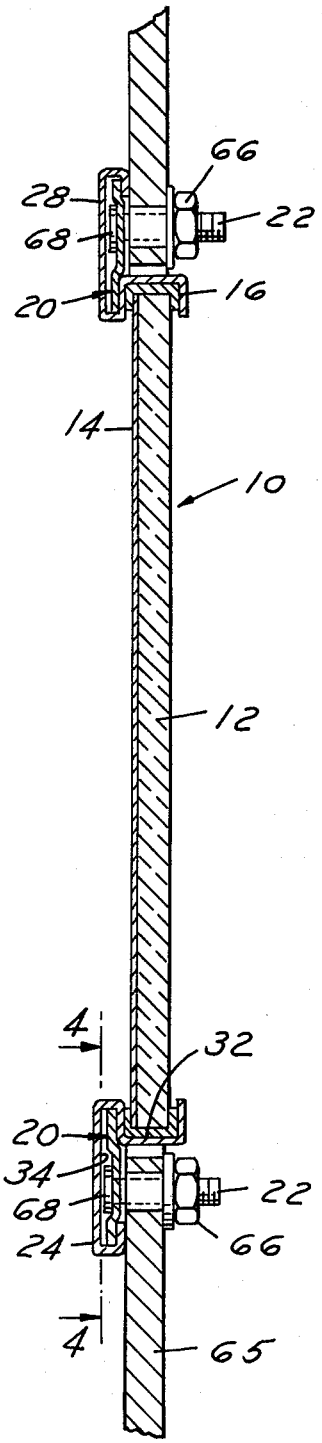
FIG. 2 is a sectional view taken on the line 2—2 in FIG. 1.
Figure 3:
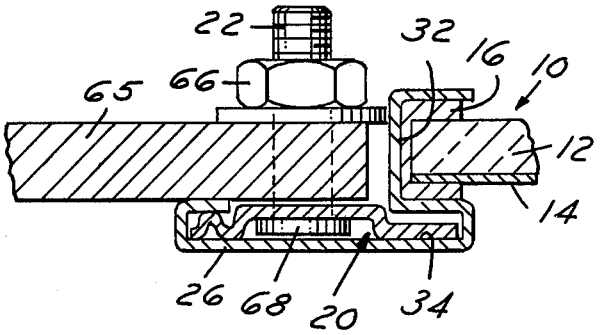
FIG. 3 is a fragmentary sectional view taken on the line 3—3 in FIG. 1.
Figure 4:
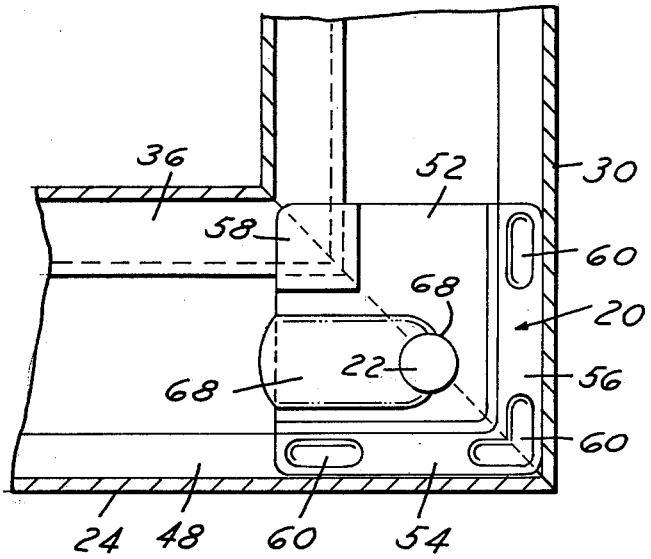
FIG. 4 is a fragmentary sectional view taken on the line 4—4 in FIG. 2.

Each bracket 20 has a hole 62 in the central portion 52 through which a threaded stud 22 projects rearwardly for the purpose of mounting the window unit over an opening in a solid fuel burner as shown in FIGS. 2 and 3 where the studs are seen entering a wall 65 of the fuel burner and have suitable nuts 66 applied. The studs have oblong heads 68 which extend within the central portions of the brackets and are prevented from rotating by contact with the edge portion 54 or 56 and the inner corner portion 58.

Additional mounting brackets or clamps 70 may be installed in one or more of the frame elements 24–30 between the corners, if necessary or desired. One such bracket 70 is shown in FIG. 1 as being a rectangular plate-like member, the central portion 72 of which is depressed rearwardly from the plane of the plate to provide the raised flange portions 74 and 76 along the inner and outer edges of the bracket. These flange portions 74 and 76 fit within the slot 34 of a frame element with the central depressed portion 72 projecting into the opening of the slot. The bracket 70 has a hole 78 in the central portion, similar to the hole 62 in each of the brackets 20, for receiving a threaded mounting stud 22. The head 68 of the stud 62 is prevented from rotating by contact with the flange portions 74 and 76 of the bracket. These additional brackets 70 may be permitted to slide within the slots 34 of the frame elements or they may be secured in place as by staking.

Figure 5:
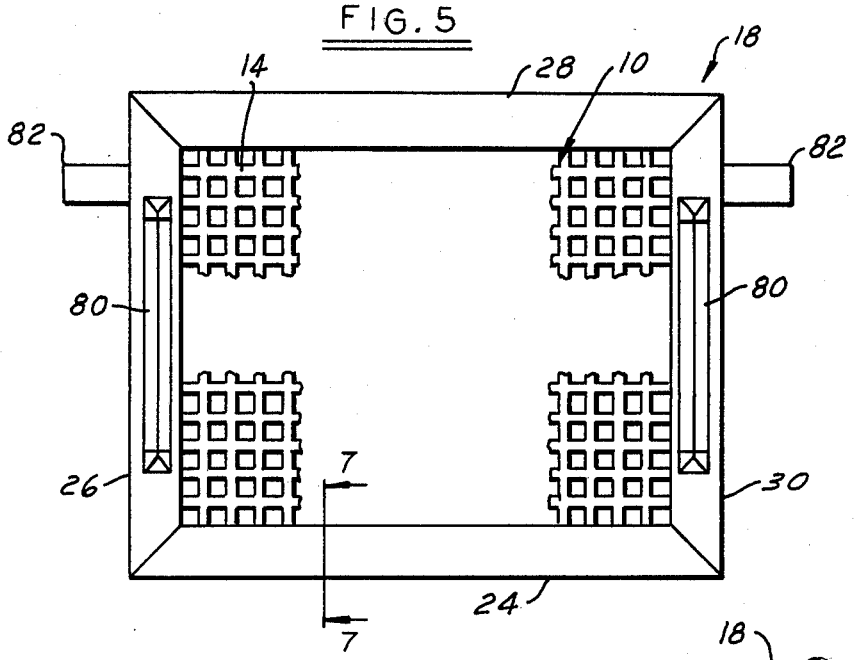
FIG. 5 is a front elevational view of a self-contained window unit of modified construction.

FIG. 5 shows a self-contained window unit of modified construction in which handles 80 are provided on the side frame elements 26 and 30 of the frame 18 for more convenient handling of the window unit. Mounting hangers 82 are secured to and project laterally outwardly from the side frame elements 26 and 30 in order to provide a means to suspend the unit over the opening of a solid fuel burner. These mounting hangers may be suspended on any suitable portion of the wall of a solid fuel burner surrounding the opening such as a door hinge, for example. When mounting hangers 82 are employed, the studs 22 are not needed.

Figure 7:
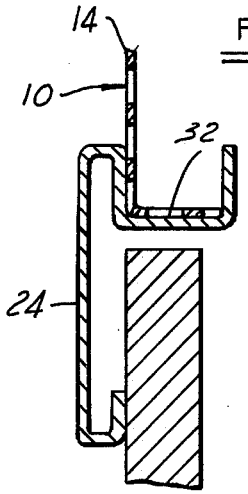
FIG. 7 is a fragmentary sectional view taken on the line 7—7 in FIG. 5.

As shown in FIG. 7, the safety shield 10 consists only of the perforated screen 14, the glass pane 12 having been omitted. Since the glass pane is omitted, there is no need for the cushion and seal element which likewise therefore has been omitted.

Figure 6:
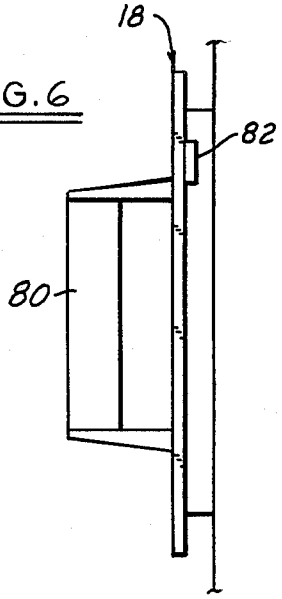
FIG. 6 is an end view of the window unit shown in FIG. 5.

It will be understood that the construction of FIGS. 5–7 may employ a safety shield of the type consisting of both the glass pane 12 and the perforated screen 14, as in FIGS. 1 to 4, or consisting only of a glass pane 12, in either of which alternative construction a cushion and seal element normally would be employed.

Except for the differences noted, the construction of FIGS. 5–7 may be like that of FIGS. 1–4.

Figure 8:
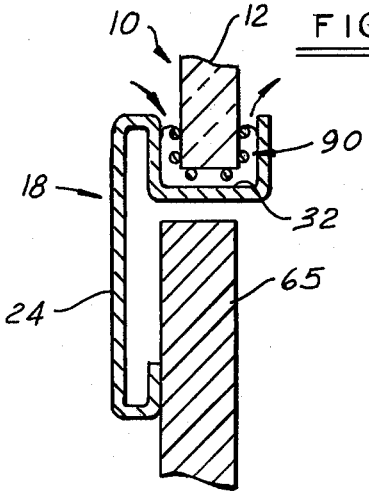
FIG. 8 is a view similar to FIG. 7 but shows a further modification.
Figure 9:
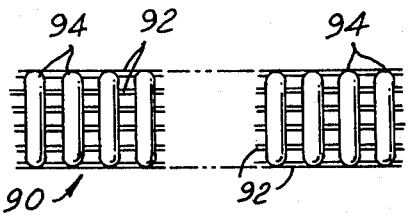
FIG. 9 is an elevational view of a portion of the cushion element shown in FIG. 8.

FIG. 8 is similar to FIG. 7 but shows a further modification in which the safety shield 10 consists of the glass pane 12 alone and in which a cushion element 90 of somewhat different construction is employed between the periphery of the glass pane and the channel 32 in the frame 18. The cushion element 90, like the element 16 previously described, is an elongated substantially continuous member about the periphery of the glass pane 12, but instead of sealing the periphery of the glass pane it allows for a controlled amount of air to pass. The cushion element 90 is composed of the laterally spaced longitudinal elements 92 connected by the longitudinally spaced transverse elements 94. The elements 92 and 94 may be formed of a cushioning material such as fiber glass. The transverse elements are thicker, that is of greater diameter, than the longitudinal elements so that air can enter around the periphery of the glass. This will minimize smoke and creosote deposits from collecting on the viewing area while still providing the necessary cushion between the frame and the glass. It will be understood that a cushion element of the type shown in FIGS. 8 and 9 may be used whether the safety shield consists solely of a glass pane or is composed of both a glass pane and a overlying screen as in FIGS. 1 to 4, but ordinarily no cushion element will be used where a perforated screen alone is used as in FIG. 7.

The window units described above provide a simple and economic means of supporting the safety shield and of mounting the unit. These units permit viewing the fire while minimizing the hazard of fire. Where a glass pane and peripheral seal are used, loss of room air is minimized. One the other hand, the seal may be designed to permit a controlled amount of air to enter around the glass to reduce the accumulation of smoke and creosote in the viewing area.

I claim:

1. A self-contained window unit for solid fuel burners and the like, comprising a rectangular safety shield, a rectangular border frame surrounding said safety shield, said frame being composed of frame elements arranged in abutting end-to-end relation providing corners where the ends abut, said frame elements being of identical, uniform cross-section from end-to-end, each frame element having means defining a channel opening inwardly of said frame, said channels connecting with one another at the corners of said frame and the peripheral edge portions of said shield being received therein, each frame element having means defining rearwardly opening slots, said slots connecting with one another at the corners of the frame, and a bracket at each corner of said frame securing said frame elements together, each bracket being disposed partially within the slots of each of the two frame elements abutting at the corner where that particular bracket is located, said brackets being provided with mounting studs for mounting said unit on a solid fuel burner or the like.

2. A self-contained window unit as defined in claim 1 wherein said studs have heads, and said brackets have relieved portions receiving said heads and surface portions coacting with said heads to limit rotation of said studs.

3. A self-contained window unit as defined in claim 1, wherein one or more additional brackets are received in a slot of said frame between corners thereof and are provided with mounting studs.

4. A self-contained window unit as defined in claim 1, wherein a substantially continuous cushion and sealing element is provided between said channels and the peripheral edge portions of said shield.

5. A self-contained window unit as defined in claim 1, wherein cushion means is provided between said channels and the peripheral edge portions of said shield, said cushion means being provided with openings to allow a controlled amount of air to pass around the periphery of said shield.

6. A self-contained window unit as defined in claim 5, wherein said cushion means is an elongated member having spaced transverse elements defining air passages and connected by longitudinal elements which are of smaller thickness than said transverse elements.

7. A self-contained window unit as defined in claim 1, wherein said shield comprises a glass pane.

8. A self-contained window unit as defined in claim 1, wherein said shield comprises a perforated screen.

9. A self-contained window unit as defined in claim 1, wherein said shield comprises a glass pane and a perforated screen.

* * * * *